United States Patent [19]

Kuswa et al.

[11] Patent Number: 4,675,145

[45] Date of Patent: Jun. 23, 1987

[54] MAGNETICALLY INSULATED DIODE FOR GENERATING PULSED NEUTRON AND GAMMA RAY EMISSIONS

[75] Inventors: Glenn W. Kuswa; Ramon J. Leeper, both of Albuquerque, N. Mex.

[73] Assignee: The United State of America as represented by the United States Department of Energy, Washington, D.C.

[21] Appl. No.: 641,225

[22] Filed: Aug. 16, 1984

[51] Int. Cl.[4] ..... H05H 7/04

[52] U.S. Cl. ..... 376/108; 376/111; 376/114; 250/423 R; 378/121; 313/361.1; 315/111.81

[58] Field of Search ..... 376/108, 111, 114, 127; 250/423 R; 378/119, 121; 313/359.1, 361.1; 315/111.81

[56] References Cited

U.S. PATENT DOCUMENTS

| | | | |
|---|---|---|---|
| 2,967,943 | 1/1961 | Gow | 376/108 |
| 2,990,476 | 6/1961 | Gow | 376/108 |
| 3,151,243 | 9/1964 | Mott | 250/253 |
| 3,258,402 | 6/1966 | Farnsworth | 376/107 |
| 3,286,162 | 11/1966 | Abragan et al. | 324/300 |
| 3,338,789 | 8/1967 | Fink | 376/108 |
| 3,532,915 | 10/1970 | Evrard | 376/144 |
| 3,569,755 | 3/1971 | Noble | 313/61 |
| 4,126,806 | 11/1978 | Kapetnakos et al. | 313/155 |
| 4,210,813 | 7/1980 | Romanovsky et al. | 250/421 |

OTHER PUBLICATIONS

Johnson et al., "Production of 0.5-TW Proton Pulses with a Spherical Focusing, Magnetically Insulated Diode", Phys Rev Lett. 42, 1979, pp. 610-613.

Kozlovskii et al., "Use of a Laser-Plasma Anode in a Magnetically Insulated Ion Diode", Sov. Phys. Tech. Phys. 25(6), Jun. 1980, pp. 694-696.

Mendel et al., "Performance of a Plasma-Filled Series--Field-Coil Ion Beam Diode", J. Appl. Phys., 53(11), 11/82, p. 7265.

"Particle Beam Fusion", Sandia Labs, 1/80.

*Primary Examiner*—Richard D. Lovering
*Assistant Examiner*—Eric Jorgensen
*Attorney, Agent, or Firm*—George H. Libman; Judson R. Hightower

[57] ABSTRACT

A magnetically insulated diode employs a permanent magnet to generate a magnetic insulating field between a spaced anode and cathode in a vacuum. An ion source is provided in the vicinity of the anode and used to liberate ions for acceleration toward the cathode. The ions are virtually unaffected by the magnetic field and are accelerated into a target for generating an nuclear reaction. The ions and target material may be selected to generate either neutrons or gamma ray emissions from the reaction of the accelerated ions and the target. In another aspect of the invention, a field coil is employed as part of one of the electrodes. A plasma prefill is provided between the electrodes prior to the application of a pulsating potential to one of the electrodes. The field coil multiplies the applied voltage for high diode voltage applications. The diode may be used to generate a $^{7}Li(p,\gamma)^{8}Be$ reaction to produce 16.5 MeV gamma emission.

18 Claims, 6 Drawing Figures

MAGNETICALLY INSULATED DIODE FOR GENERATING PULSED NEUTRON AND GAMMA RAY EMISSIONS

The United States Government has rights to this invention pursuant to Contract No. DE-AC04-76DP00789 between the United States Department of Energy and AT&T Technologies, Inc.

TECHNICAL FIELD

The invention relates generally to magnetically insulated diodes and more particularly concerns a diode for generating pulsed neutron sources for irradiating a substance that then emits radiation, such as neutrons or gamma rays. The invention will be specifically disclosed in connection with a high power density magnetically insulated diode for generating a nonfocused source of neutrons or high energy gamma rays. The magnetically insulated diode of the invention may be used for a variety of applications where a neutron or gamma source is needed, such as medical or industrial radiography or irradiating substances for nuclear reaction diagnostics.

BACKGROUND OF THE INVENTION

The use of neutron sources to irradiate a substance which emits radiation that is characteristic of the atoms present in the irradiated substance is a widely recognized diagnostic technique. For example, in oil logging applications, a neutron source is inserted into a hole of a geological formation. When the neutrons strike a very low mass particle, such as hydrogen in an oil deposit, they scatter and lose approximately one half of their energy. By detecting the echo levels of neutrons that return at reduced energy levels, information as to the content of the geological formation can be obtained. Although hydrocarbons reduce neutron energy levels in approximately the same manner as hydrogen in water, independent tests for the water content can also be used and combined with the neutron echo information to provide indications as to the amount of potential of oil in a formation. Uranium logging can also be conducted along similar lines wherein neutrons are directed into a formation to produce fissions in any uranium in the formation.

Conventional prior art devices for generating neutrons typically accelerate deuterium ions to 100–200 keV potentials for striking a tritium target to produce nominal 14 MeV neutrons. One type of prior art neutron generating device uses high vacuum and a plasma source triggered by passing current through a hydrided surface prior to application of an accelerating voltage. Another type of device uses a gas fill whose pressure is adjusted by means of a gas-absorbing reservoir controlled with a heater. The former design has a lifetime limited to a few hundred shots, and the latter device has a rather limited operating range and is hard to control.

Because electrons tend to be present in vacuum or low pressure gas devices that are subject to high electrical stress and are much more readily accelerated than ions, a chief design problem in ion beam generation is to reduce electron production. In conventional neutron generating devices, this is accomplished by operating at modest electric fields, so that electrons are not emitted in large quantities. In such devices, only modest ion currents can be produced, and obtaining large quantities of neutrons per pulse requires long pulses. Disadvantageously, long pulses stress the insulating envelope of a neutron tube, and some components of the electric supply current more than short pulses. Short pulses also enable more precise measurements of reflected neutrons or decay radiation and a greater time interaval is allowed for measurements.

In order to ameliorate the problems associated with high electron production, magnetically insulated diodes have been developed. When a high electrical stress is applied across a pair of diode electrodes in a vacuum, a layer of plasma is formed on the negative electrode surface, and electrons are emitted from the plasma toward the positive electrode to form an electron beam. This electron flow is controlled or inhibited in a magnetically insulated diode with the application of a magnetic field in a direction transverse to the electron flow. The electrons get trapped in the magnetic field lines and this results in the formation of an electron cloud having a strong negative charge adjacent the negative electrode.

If a proton source is provided in the vicinity of the positive electrode, the strong negative charge of the electron cloud will attract and accelerate strong proton flow. Unlike the electrons, the protons, which have masses which are approximately 1800 times that of electrons, flow through the magnetic field virtually undeflected. Ion diodes, in which positive ions are introduced in the vicinity of the positive electrode and accelerated toward the negative electrode are constructed on this principle.

In one prior art magnetically insulated ion diode a cylindrically shaped anode is concentrically disposed inside a cathode, also of cylindrical shape. A coil is positioned about the cathode to generate a magnetic field, and the entire diode is disposed inside a vacuum chamber. A laser is focused on a titanium deuteride target inside the anode, and the pulse of the laser is used to generate predominatly single-charged titanium and deuterium ions. A short time after the laser pulse, a pulse of approximately 80–150 keV is applied to the anode, and ion flow from the anode toward the cathode is generated.

The use of a laser is a highly reliable method of generating ions to be accelerated in a diode. However, the complexity of such an arrangement is impractical for many important commercial applications, such as in the oil well logging operations described above, for example. Furthermore, such prior art diodes have been relatively large and bulky. In addition, the coil used for generating the necessary magnetic field requires a bulky power supply. The insulation of leads to the solenoid and the removal of waste heat may also present formidable problems in many applications.

SUMMARY OF THE INVENTION

Accordingly, it is a principal object of the invention to provide a magnetically insulated diode of compact construction.

It is another object of the invention to provide a magnetically insulated diode of simple design.

Yet another object of the invention is to provide an easily manufactured magnetically insulated diode capable of a wide variety of commercial applications.

Another primary object of the invention is to provide a diode capable of generating magnetic fields to inhibit electron flow without the necessity of bulky power supplies normally associated with powered magnets.

It is yet another object of the invention to provide a highly portable diode for generating neutrons.

Another object of the invention is to provide a diode capable of generating nuclear gamma ray emission.

It is still another object of the invention to provide a diode for generating a relatively short, high intensity ion pulse for producing a correspondingly short, high intensity pulse of neutrons or gamma ray radiation.

It is yet another object of the invention to provide a pulsed magnetically insulated diode capable of generating an electrical potential across the diode which is greater than the electrical potential of the supply pulse.

Additional objects, advantages, and other novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention disclosed herein, an improved magnetically insulated diode is provided for generating neutrons or gamma ray emissions. The diode includes a cylindrical anode and a cylindrical cathode coaxially aligned, with one of the anode and cathode inside the other, forming an acceleration gap therebetween. The diode includes means for maintaining a vacuum in the space between the anode and the cathode and means for applying an electrical potential between these two electrodes. A magnet is positioned only within the outermost of the anode or cathode to produce a magnetic field primarily parallel to and inbetween the surfaces of the anode and cathode. Thus, the magnetic field is applied in a direction transverse to electron flow. In order to properly inhibit electron flow, the magnetic field must also be strong enough to make the gyration radius of an electron originating on the cathode surface smaller than the acceleration gap dimension when peak voltage is reached. Means are also provided for producing ions in the vicinity of the anode. The ions are accelerated by the electrical potential across the acceleration gap substantially undeflected by the magnetic field into a target material disposed in the vicinity of the cathode.

The ions for acceleration may be produced by a dielectric material rich in the ions to be accelerated. Means for breaking down the dielectric material to free the ions, such as an electric pulse, is also provided.

In accordance with one aspect of the invention, the dielectric material is interspaced on the surface of the anode to provide a flashover surface.

In accordance with a further aspect of the invention, the ions accelerated across the electrode gap are nonfocused so as not to destroy the target material.

In accordance with another specific aspect of the invention, the outermost of the anode and cathode serves as a vacuum wall for isolating the space between the electrodes from the ambient atmosphere.

In accordance with still another specific aspect of the invention, the anode is disposed within the cathode and the ions are accelerated radially outward toward the cathode in a nonfocused manner at all positions along the cylindrical surface of the anode.

In a further aspect of the invention, the anode has at least one groove interspaced on the anode surface, and the dielectric material is deposited in the groove to form a flashover surface for the production of the ion to be accelerated.

In accordance with another aspect of the invention, at least one of the dielectric material and the target material is a deuterated material.

In accordance with still another aspect of the invention, the dielectric material is a deuterated material and the flashover material produces deuterium ions upon breakdown. When the deuterium ions impact the target material, the target material then emits radiation that is characteristic of the atoms present.

In one embodiment of the invention, the magnet is one or more cylindrical permanent magnets forming a part of either the inner or outer electrode. In another embodiment, the magnet is a coil in series with or forming at least a part of one of the anode and cathode and excited in response to the application of the electrical pulse to generate a magnetic field between and primarily parallel to the anode and cathode surfaces for insulating electron flow between the anode and cathode.

In accordance with another aspect of the invention, means are provided for filling the space between the anode and cathode with a plasma prior to the application of the electrical pulse to the anode. Under such prefill conditions, the diode voltage rises for a short time to voltages in excess of the supply voltage. This is caused when the tube impedance rises due to alteration in the plasma caused by current flowing in the diode, resulting in higher voltage pulses than possible in compact prior art devices. Advantageously then, the present invention allows more effective use of neutron production and the irradiation of substances to obtain 16.5 MeV gamma rays.

Still other objects of the present invention will become readily apparent to those skilled in this art from the following description wherein there is shown and described a preferred embodiment of this invention, simply by way of illustration, of one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings, incorporated in and forming a part of the specification, illustrate several aspects of the present invention, and together with the description, serve to explain the principles of the invention. In the drawings.

Reference will now be made in detail to the present preferred embodiments of the invention, examples of which are illustrated in the accompanying drawings.

DETAILED DESCRIPTION OF THE INVENTION

Figure 1:
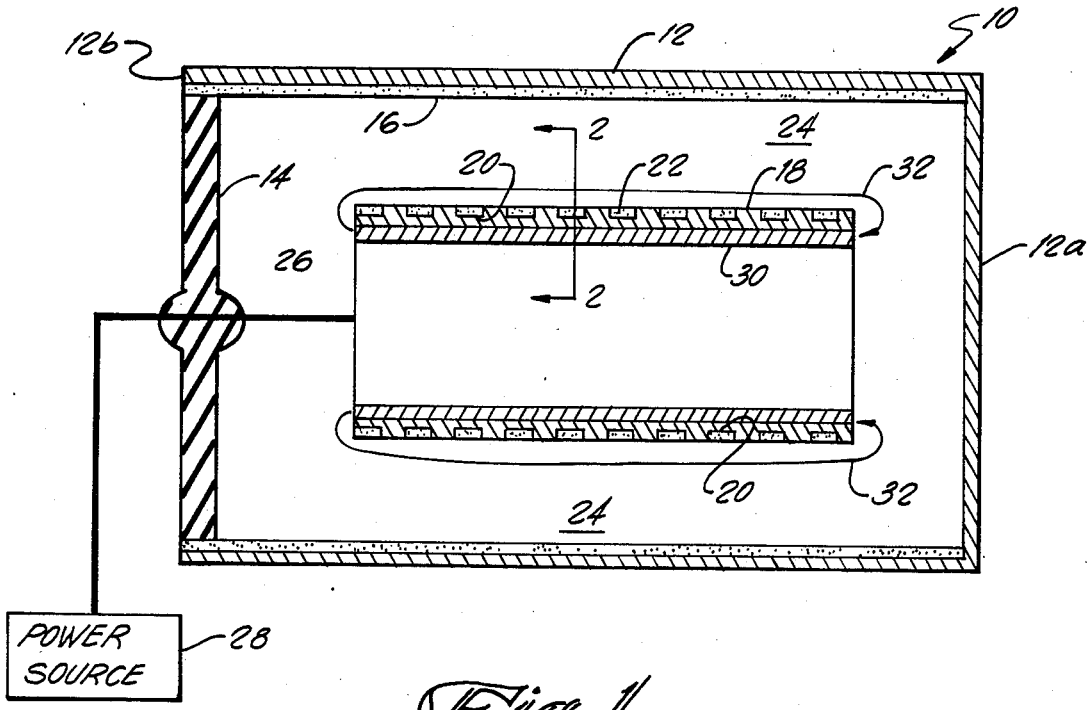
FIG. 1 is a cross-sectional elevational view of the magnetically insulated diode constructed in accordance with the principles of the invention.

Referring now to the drawings, FIG. 1 depicts a magnetically insulated diode 10 constructed in accordance to the principles of the present invention. The illustrated diode 10 includes a first cylindrical electrode 12 having one closed end 12*a* and one open end 12*b*. An insulator 14 is sealingly fitted in the open end 12*b*. The insulator 14 cooperates with the cylindrical walls of electrode 12 to seal the interior of the diode from the ambient atmosphere and maintain a vacuum therein. As will be discussed hereinafter, the electrode 12 may be used as either the cathode or the anode in the diode operation. However, for purposes of explanation, the electrode 12 will be initially described as a cathode.

The interior cylindrical surface of electrode 12 is covered with a coating 16 of an appropriate target material. The material for target coating 16 will vary depending upon the intended purpose of the diode 10. For example, if the diode is designed to generate neutrons, a deuterium or tritium compound could advantageously be employed as the coating 16. Alternatively, if it is desired to generate gamma rays with the diode 10, the coating 16 could be formed from a lithium compound.

A second electrode 18, also of cylindrical configuration in the illustrated embodiment, is concentrically disposed within the electrode 12. The electrode 18, like the electrode 12, may function as either a cathode or an anode, but for purposes of explanation, will be initially described as the anode.

Figure 2:
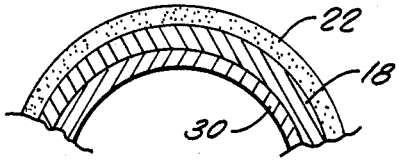
FIG. 2 is a fragmentary cross-sectional view of the internal electrode of the diode of FIG. 1 showing the relative position of a permanent magnet and also depicting a dielectric flashover material deposited in grooves on the surface of the electrode.

The anode 18 may be formed of any suitable conductive material, such as aluminium, for example. As seen in both FIGS. 1 and 2, the illustrated anode 18 has a series of spaced regions such as grooves 20 extending about the external cylindrical surface. These grooves 20 are filled with a suitable dielectric material 22 that contains an ion species to be accelerated across an acceleration gap 24 between the electrodes 12,18. The dielectric material 22 may also vary in accordance with the intended purpose of the diode 10. For example, if it is desired to accelerate protons, virtually any organic compound as well as many inorganic compounds that contain the ion to be accelerated will suffice as the dielectric material 22. In one preferred form of the invention for accelerating deuterium ions, the dielectric material 22 is formed of a deuterated organic material in which the normal hydrogen atom in the organic compound is replaced with deuterium, but again, inorganic compounds containing deuterium can be substituted. Other examples of suitable ion sources include lithium hydride and lithium deuteride. The dielectric material 22 is preferably rich in the ion to be accelerated and has few lighter contaminant ions.

A conductor, shown as a wire 26 in FIG. 1, extends through the insulator 14 into the vacuum chamber formed by the cathode 12. The conductor applies an electrical pulse to the anode 18 from an external power source 28. When the electrode 12 is connected to ground, this pulse results in an electrical stress across an acceleration gap 24 formed between the anode 18 and cathode 12. A plasma layer forms on the interior surface of the cathode 12 as a result of this electrical stress and electrons begin to flow from the plasma layer toward the anode 18.

In accordance with one of the aspects of the invention, a permanent magnet 30 is disposed within the diode 10 depicted in FIG. 1. The illustrated magnet 30 is of cylindrical configuration and concentrically positioned inside the anode 18. An annular magnetic insulating field, indicated by the arrows 32, is generated by the magnet 30 between and primarily parallel to the surfaces of the respective electrodes 12 and 18 transverse to electron flow that would exist in the absence of the magnetic field. In the embodiment shown the field lies primarily axial to the device, but another arrangement of the field in the azimuthal direction may be employed. This magnetic field alters the trajectories of electrons emitted from the cathode 12 and inhibits electron flow in the acceleration gap 24. The magnetic insulation of the electrodes 12, 18 provided by the magnet 30 results in the formation of an electron cloud (not shown) immediately adjacent the inner cylindrical surface of cathode 12.

For reasons which are not completely understood, the high electrical stress across electrodes 12 and 18 also causes the dielectric material 22 deposited in interspaced grooves 20 on anode 18 to flashover and to produce a source of selected ions. The strong negative charge of the electron could in front of the cathode 12 accelerates these liberated ions toward the cathode 12, causing the accelerated ions to strike the target coating 16 on the interior cylindrical surface of the cathode 12. When the accelerated ions are deuterium ions and the target coating 16 is formed of a deuterium or tritium compound, neutrons are emitted from the resulting deuterium-deuterium or deuterium-tritium reactions at the target coating 16. The diode 10 may thus be used as a compact neutron source.

As indicated above, the diode 10 may also be used to generate high powered gamma emissions. This may be accomplished, for example, by coating the anode 12 with a lithium target material 16 and accelerating proton ions with a minimum 440 keV potential into the target material 16. When proton ions accelerated to a minimum of 440 keV potential strike a lithium target, a $^{7}Li(p, \gamma)^{8}Be$ reaction results, and a 16.5 MeV average nuclear gamma emission is produced. As those skilled in the art will appreciate, this same gamma emission may also be accomplished by accelerating lithium ions into a proton rich target. However, acceleration of the proton ions may be preferred over lithium ions due to their lighter weight.

Significantly, the diode 10 does not focus the generated ion beams or the resulting neutrons or gamma emissions. The accelerated ions cross the acceleration gap 24 at all positions along the cylindrical surface of the anode 18, and the generated neutron beam or gamma rays pass through the electrodes 12, 18 and leave the diode system. The nonfocused manner of the generated beams is advantageous for certain applications in that an excessively well focused ion beam would heat up the diode 10 and destroy the target coating material 16.

For single pulse applications, however, it may be advantageous to use a highly focused beam in order to minimize the quantity of target material. For example, the polarity of the device shown may be reversed and the beam focused inward radially to a target mounted in the vicinity of the axis, resulting in a smaller volume and area of target material. One example of the usefulness of this alternative configuration would be in the case of a tritiated target. Over a period of time in some conventional neutron tubes such a target evolves helium gas due to the radioactive decay of tritium. Disadvantageously, this helium gas impedes the operation of the tube. The focusing embodiment can reduce the tritium inventory substantially over previous traditional designs because much higher focused current densities are possible than in conventional tubes. In addition, the tritium radiological hazard risk is reduced.

The use of a permanent magnet 30 in the diode 10 is particularly advantageous in that it enables the diode 10 to be compact and to be operated without the bulky power supplies normally required for powered magnets. The magnetic field distribution can also be tailored with permanent magnets in ways that are difficult to do with pulsed powered magnets due to the tendency of the lines of force from pulsed magnetic fields to penetrate the conductors in a dynamic process. Additionally, with pulsed powered magnets, the desired field pattern may exist for only a very short time, limiting the possible operating pulse of the diode and/or preventing rapid diode cycling. The insulation of leads to magnet coils and the removal of waste heat from magnet coils and the shorting of electrical leads to coils in a vacuum environment also present formidable problems with powered magnets.

Figure 3:
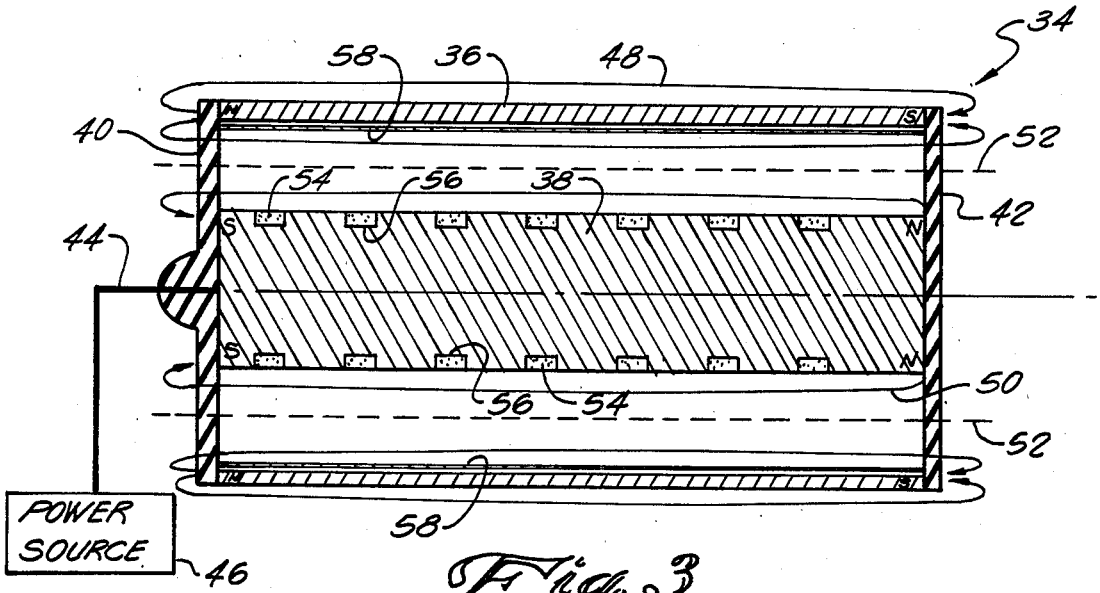
FIG. 3 is a cross-sectional elevational view of a further embodiment of a magnetically insulated diode employing the concepts of the invention.

FIG. 3 depicts a diode 34 with a further arrangement of permanent magnets which may be advantageously employed in the concentric diode configuration used in FIG. 1. In the FIG. 3 embodiment, two cylindrical concentric magnets 36, 38 are disposed with the axial ends of the two magnets 38, 38 having the same polarity. The exterior or outer concentric magnet 36 could be substituted for electrode 12 in the FIG. 1 configuration, and the interior concentric magnet 38 could be substituted for both electrode 18 and magnet 30 of FIG. 1. Thus, a workable diode may employ a single magnet or a plurality of magnets.

The magnets 36,38 are maintained in spaced relationship by insulators 40 and 42 connecting opposite axial ends of the magnets 36,38. The insulators 40, 42 sealingly engage the axial ends of magnet 36 to maintain a vacuum chamber inside the magnet 36. The illustrated diode 34 includes a conductor 44 extending from a pulsed power source 46 through insulator 40 to apply an electrical pulse to the magnet 38.

As indicated by arrows 48 and 50 representing magnetic flux lines from magnets 36 and 38 respectively, the flux lines extend between and primarily parallel to the cylindrical surfaces of the magnets 36, 38 and are in the same direction. Where two separate magnets are used and, for example, the center or interior magnet 38 is the positive electrode of a diode, the outer magnet 36 becomes the negative electrode. No magnetic field lines connect the two electrodes 36, 38 and the insulating properties of the diode 34 structure are very good. If a single magnet were to be employed, however, at least some field lines would connect the anode and cathode and a less pefect magnetic insulation would exist. In the FIG. 3 arrangement, the magnets 36 and 38 serve as the electrodes with a dielectric material 54 deposited in interspaced grooves 56 on the exterior surface of magnet 38 to provide a flashover source. An appropriate target coating 58, similar to target coating 16 shown in FIG. 1, is provided on the interior cylindrical surface of magnet 36. Alternatively, electrodes could be plated over the magnets 36, 38 or otherwise positioned in the vicinity of the magnets. With either alternative the operation of the diode 34 for the generation of neutrons and gamma rays is substantially the same as described above with respect to diode 10 shown in FIG. 1.

Permanent magnets are preferred as a pulsed magnetic system that could accomplish the same insulating properties as permanent magnets 36 and 38 in FIG. 3 would require leads to the magnets and, in the presence of electrodes made from conductors, the fields would constantly vary as the magnetic flux penetrates the conductors.

It will be appreciated by those skilled in the art that the electrical pulse from the supply source (28 or 46) could be applied to the external electrodes (12 or 36) of FIGS. 1 and 3, and the direction of current flow (electron or ion) in the diode is a matter of design preference. It is important, however, that the ion source, such as dielectric material 22 or 54 in FIGS. 1 and 3 respectively, be disposed proximal to the anode.

It will also be appreciated by those skilled in the art that magnets that are separate from the electrode structures or are used in conjunction with magnets within electrodes may be used to produce insulating fields.

Figure 4:
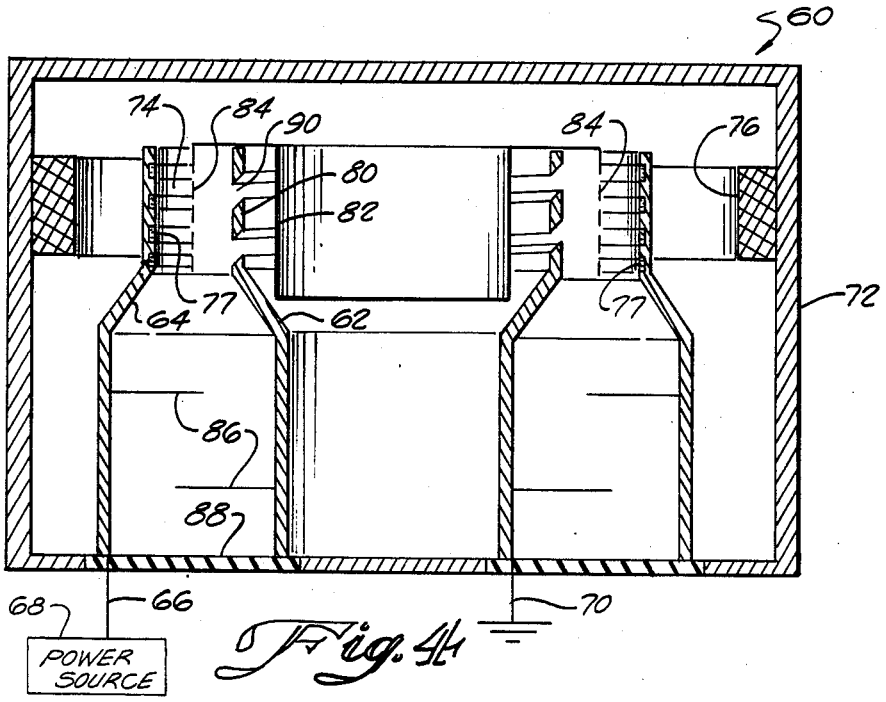
FIG. 4 is a cross-sectional elevational depiction of an automagnetic plasma-filled diode construction in accordance with the principles of the invention.
Figure 6:
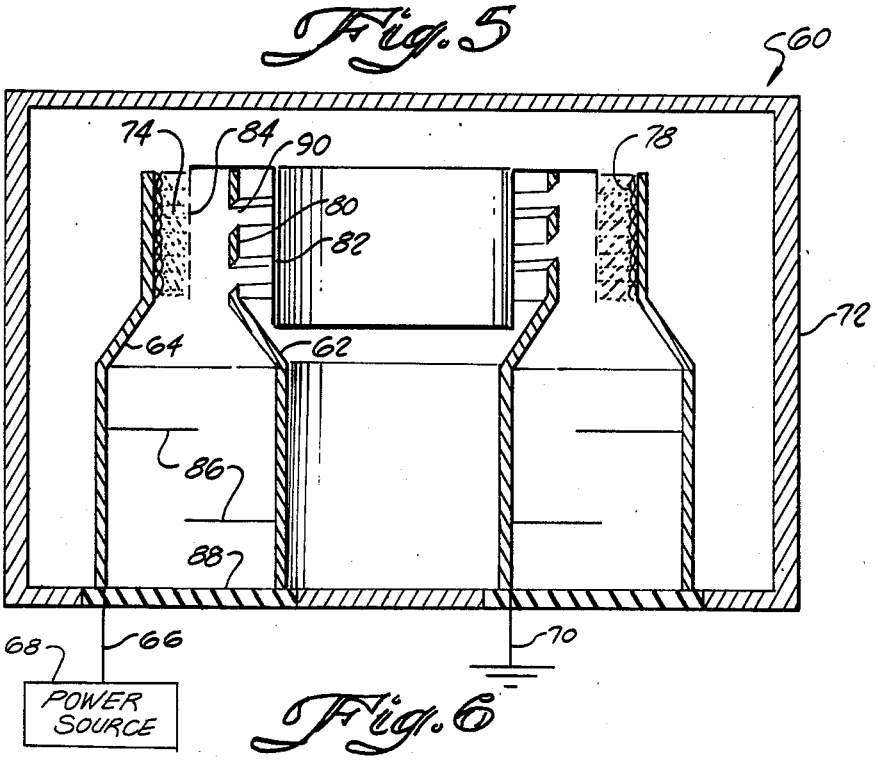
FIG. 6 is a cross-sectional elevational depiction of an additional embodiment of an automagnetic plasma-filled diode constructed in accordance with the principles of this invention.

A coaxial design for a compact automagnetic plasma-filled ion diode 60 for generating neutrons or gamma emissions is depicted in FIGS. 4 and 6. The diode 60 is formed by a cathode 62 concentrically disposed within an anode 64. An electrical lead 66 connects the anode 64 to an external pulsating electrical power source 68, and an electrical lead 70 connects the cathode 62 to ground.

A tube envelope 72 surrounds the anode 64 and cathode 62 to isolate the electrodes 62,64 from the ambient atmosphere and to maintain a vacuum between the electrodes 62, 64.

Means are also provided in the diode 60 for filling an acceleration gap 74 between the anode 64 and cathode 62 with a plasma prefill. The plasma prefill may be obtained by an externally pulsed plasma gun 76, illustrated in FIG. 4 as an annular ring structure surrounding the electrodes 62, 64. Alternatively, the plasma prefill may be obtained from a flashover source as represented by a dielectric mesh 78 surrounding the anode 64 as illustrated in FIG. 6. A preliminary electrical pulse, prior to the primary electrical pulse to anode 64, must be applied to either the plasma gun 76 or the flashover surface formed by the mesh 78 to generate plasma and fill the acceleration gap 74 with the generated plasma prior to the primary diode pulse. The preliminary pusle may be generated in power source 68 or another external power source.

When the primary diode pulse is applied to the anode 64, the plasma prefill (resulting from the preliminary pulse) initially permits electron flow in the diode 60 across the electrodes 62, 64. The cathode 62, however, includes a field coil 80 which is excited by the current diode 60. Once excited, the field coil 80 generates a magnetic insulating field between and primarily parallel to the electrodes 62, 64. This magnetic insulating field inhibits electron flow across the anode-cathode acceleration gap 74 to produce a rapidly rising impedance and, therefore, a rapidly rising voltage across the acceleration gap 74. In practice, the voltage across the electrodes 62, 64 significantly exceeds the voltage from pulsed power source 68. As in the embodiments discussed above, the insulated electron flow and the electrical potential in the vacuum between the anode 64 and cathode 62 causes ions liberated from the dielectric material 77 (FIG. 4) or flashover mesh 78 (FIG. 6) to flow toward the cathode 62. A target 82 is disposed in the vicinity of the cathode 62, and the accelerated ions from dielectric material 77 (FIG. 4) or the flashover mesh 78 (FIG. 6) strike the target 82 to produce nuclear reactions similar to the embodiments of FIGS. 1 and 3.

The diode 60 may also optionally include a grid 84 disposed in front of and electrically connected to the field coil 80. The grid 84 aids in spatially smoothing the accelerating potential and protecting the field coil 80 from locally excessive current. The diode 60 may also include a series of barriers 86, illustrated as radially extending strips of dielectric or conducting material, to shield an insulator 88 separating the electrical leads 66 and 70 from plasma and light. Exposure of the insulator 88 to plasma and light may cause the insulator surface to become conductive and result in an electrical breakdown of the diode 60.

Figure 5:
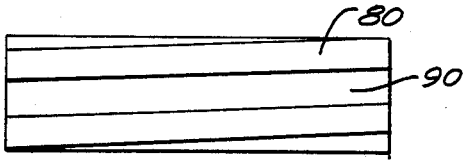
FIG. 5 is an elevational view of the field coil used in the diode of FIG. 4.

As more clearly seen from the depiction of FIG. 5, the field coil 80 is a conducting cylindrical structure formed into a spiral annulus with a spiral slot 90. Depending upon the required magnetic field and the current passing through the diode 60, the coil 80 may be formed of a plurality of such annular spirals.

The field coil 80 could also be part of the anode 64, or could be part of each electrode (62,64). If the field coil 80 is formed as part of each electrode 62,64, the coil windings would be arranged in reverse pitch to cause all of the magnetic field to be confined in the annular region between the anode 64 and cathode 62.

The rapidly rising voltage characteristic of the diode 60 makes the diode 60 particularly advantageous for producing relatively short, high intensity ion pulses. Moreover, the ability to generate diode voltages in excess of the voltage of the applied electrical pulse from electrical power source 68 makes the diode 60 well suited for generating the high voltage needed to produce high energy gamma rays by way of a $^{7}Li(p,\gamma)^{8}Be$ reaction in a compact structure. This reaction may be obtained by using a mesh 78 of proton rich material, using a lithium compound for the target 82 and generating a diode voltage across the acceleration gap 74 in excess of 440 keV. Other alternative reactions, such as, for instance, $^{19}F(p,\alpha\gamma)^{16}O$ may be used to produce other energies of $\gamma$ rays.

In summary, numerous benefits have been described which result from employing the concepts of the invention. The magnetically insulated diode of the invention is simple in design and easy and inexpensive to manufacture. The diode generates relatively short, high density pulses of ion currents. The ion beams are preferably nonfocused and do not destroy a target. The simplicity and compact design of the diode make it most suitable for a number of commercial applications requiring a neutron or gamma ray source. The use of permanent magnets permits more rapid pulsing than is possible from conventional pulsed power magnets. Permanent magnets also avoid the high stress of conventional coils and the heat dissipation problems associated with such coils. Applicant's use of permanent magnets also results in a more compact design, since a power supply to operate the coils is not needed. Permanent magnets reduce weight, complexity and power supplies and controls, and significantly reduce the power requirements of the diode.

The use of an automagnetic plasma-filled ion diode design, while suffering from some of the disadvantages of coil heating, offers significant advantages in voltage multiplication. A diode which mutliplies supply voltage is highly advantageous in generating the high voltage needed to produce gamma ray emissions by a $^{7}Li(p,\gamma)^{8}Be$ reaction in a compact source. The ability to generate gamma emissions in a compact source opens a vast array of new uses for gamma rays.

The foregoing description of preferred embodiments of the invention has been presented for purposes of illustration and description. It is not intended to be exhaustive or to limit the invention to the precise forms described. Obvious modifications are possible in light of the above teachings. For example, in space applications, such as on a sattellite, and envelope surrounding the electrodes would be unnecessary, since the vacuum could be provided by the space environment itself, and the vacuum between the electrodes would be maintained by the positioning of the diode within the space environment. Additionally, it will be appreciated that permanent magnets may be disposed either inside or outside the envelope surrounding the electrodes. A design with externally disposed magnets would offer economy of replacement, because the tube element would be very simple. Furthermore, an external design would make the use of expensive magnets more economically feasible, since the same magnets could be used with multiple disposable tubes. The embodiments were chosen and described in order to best illustrate the principles of the invention and its practical application to thereby enable one of ordinary skill in the art to best utilize the invention in various embodiments as are suited to the particular use contemplated. It is hereby intended that the scope of the invention be defined by the claims appended hereto.

We claim:

1. A magnetically insulated diode comprising:

(a) a first cylinder defining an anode;

(b) a second cylinder defining a cathode in predetermined spaced relationship to said anode, said cathode cooperating with said anode to form an acceleration gap therebetween, one of said anode or cathode being disposed within and axially aligned with the other of said anode or cathode;

(c) a target material for receiving accelerated ions, said target material being disposed adjacent said cathode;

(d) means for maintaining a vacuum in the space between said anode and said cathode;

(e) means for applying an electrical potential between said anode and said cathode;

(f) magnet means, positioned only within the outermost of said cylinders, for producing a magnetic field that lies between and primarily parallel to the cylindrical surfaces of said anode and cathode for inhibiting electron flow therebetween; and (g) means for producing ions in the vicinity of said anode, said ions being accelerated across the acceleration gap and into the target material by the electrical potential.

2. A magnetically insulated diode as recited in claim 1 wherein said ion producing means includes a dielectric material rich in the ions to be accelerated and means for breaking down the dielectric material to free the ions for acceleration.

3. A magnetically insulated diode as recited in claim 2 wherein the means for breaking down the dielectric material includes an electrical pulse.

4. A magnetically insulated diode as recited in claim 3 wherein the dielectric material is interspaced on the surface of the anode facing said cathode to provide a flashover surface.

5. A magnetically insulated diode as recited in claim 4 wherein the outermost cylinder serves as a vacuum wall for isolating the space between the anode and cathode from the ambient atmosphere.

6. A magnetically insulated diode as recited in claim 5 wherein the anode is concentrically disposed within the cathode, and the ions are accelerated radially outwardly toward the cathode in a nonfocused manner at all positions along the cylindrical surface of the anode.

7. A magnetically insulated diode as recited in claim 6 wherein the anode has at least one surface region whereupon the dielectric material is deposited to form the flash-over surface.

8. A magnetically insulated diode as recited in claim 7 wherein at least one of the dielectric material or the target material is a deuterated material.

9. A magnetically insulated diode as recited in claim 8 wherein said dielectric material is a deuterated material and the flashover surface produces deuterium ions upon breakdown.

10. A magnetically insulated diode as recited in claim 2 wherein one of the target material and dielectric material is a proton rich material, and the other is a lithium material, whereby the accelerated proton ions strike the target material to produce gamma ray emission.

11. A magnetically insulated diode as recited in claim 10 wherein said cathode is concentrically disposed within said anode and said electrical potential applying means includes an electrical pulse supply source for applying an electrical pulse in excess of 440 keV to said anode and to said magnetic field means, said magnetic field means comprising a field coil coaxially aligned with, and spaced between, said anode and cathode and being excited in response to the application of the electrical pulse to generate a magnetic field between and primarily parallel to the anode and cathode surfaces for inhibiting electron flow between said anode and cathode.

12. A magnetically insulated diode as recited in claim 11 further including means for filling the space between the anode and cathode with plasma prior to the application of the electrical pulse to the anode.

13. A magnetically insulated diode as recited in claim 12 wherein plasma filling means includes a flashover surface.

14. A magnetically insulated diode as recited in claim 13 wherein the flashover surface includes dielectric strips imbedded in the anode.

15. A magnetically insulated diode as recited in claim 4 wherein the ions accelerated across the electrode gap are nonfocused and said magnet means is a permanent magnet.

16. A magnetically insulated diode as recited in claim 15 wherein said inner cylinder comprises said permanent magnet.

17. A magnetically insulated diode comprising:

a. a coaxial pair of cylinders, each cylinder comprising a permanent magnet magnetically polarized in the same direction as the other cylinder, one of said cylinders defining an anode and the other of said cylinders defining a cathode, the space between said cylinders forming an acceleration gap therebetween, wherein the magnetic field lines of each magnet are (i) primarily parallel to surfaces of said cylinders for inhibiting electron flow therebetween and (ii) repelled from the opposite cylinder by the magnet field of that cylinder;

b. a target material for receiving accelerated ions, said target material being disposed adjacent said cathode;

c. means for maintaining a vacuum in the space between said anode and said cathode;

e. means for applying an electrical potential between said anode and said cathode; and f. means for producing ions in the vicinity of said anode, said ions being accelerated across the acceleration gap and into the target material by the electrical potential.

18. A magnetically insulated diode as recited in claim 17 wherein the inner cylinder forms the anode and the outer cylinder forms the cathode of the diode.

* * * * *